United States Patent [19]

Blanton, Jr.

[11] 4,290,878

[45] Sep. 22, 1981

[54] $NO_x$ CONTROL IN PLATINUM-PROMOTED COMPLETE COMBUSTION CRACKING CATALYST REGENERATION

[75] Inventor: William A. Blanton, Jr., Woodacre, Calif.

[73] Assignee: Chevron Research Company, San Francisco, Calif.

[21] Appl. No.: 146,831

[22] Filed: May 5, 1980

Related U.S. Application Data

[63] Continuation-in-part of Ser. No. 965,978, Dec. 8, 1978, abandoned.

[51] Int. Cl.[3] ..... C10G 11/18; C10G 11/22

[52] U.S. Cl. ..... 208/120; 208/121; 252/416; 252/466 PT; 423/239

[58] Field of Search ..... 208/120, 121, 520 T; 423/239

[56] References Cited

U.S. PATENT DOCUMENTS

| | | | |
|---|---|---|---|
| 3,118,727 | 1/1964 | Cohn | 423/239 |
| 3,806,582 | 4/1974 | Acres et al. | 423/239 |
| 4,053,556 | 10/1977 | Acres et al. | 423/239 |
| 4,093,535 | 6/1978 | Schwartz | 208/120 |
| 4,122,039 | 10/1978 | Kobylinski et al. | 423/239 X |
| 4,134,860 | 1/1979 | Hindin et al. | 252/472 X |
| 4,198,287 | 4/1980 | Hemler et al. | 208/113 |
| 4,214,978 | 7/1980 | Kennedy et al. | 208/120 |
| 4,222,856 | 9/1980 | Hansel et al. | 208/120 |
| 4,235,754 | 11/1980 | Chester | 208/120 X |

*Primary Examiner*—Delbert E. Gantz
*Assistant Examiner*—G. E. Schmitkons
*Attorney, Agent, or Firm*—D. A. Newell; S. R. LaPaglia; J. W. Ambrosius

[57] ABSTRACT

In regeneration of a cracking catalyst using platinum to catalyze combustion of CO, the amount of nitrogen oxides formed is decreased by empolying a combustion promoter containing, for each part of platinum, from 0.01 to 1 part of iridium or rhodium.

5 Claims, No Drawings

$NO_x$ CONTROL IN PLATINUM-PROMOTED COMPLETE COMBUSTION CRACKING CATALYST REGENERATION

CROSS-REFERENCE TO RELATED APPLICATIONS

This application is a continuation-in-part of my copending application Ser. No. 965,978, filed on Dec. 8, 1978 (now abandoned).

BACKGROUND OF THE INVENTION

The present invention relates to a method for controlling nitrogen oxides levels in flue gases generated in catalyst regenerators in hydrocarbon catalytic cracking systems.

Modern hydrocarbon catalytic cracking systems use a moving bed or fluidized bed of a particulate catalyst. Catalytic cracking differs from hydrocracking in that it is carried out in the absence of externally supplied molecular hydrogen. The cracking catalyst is subjected to a continuous cyclic cracking reaction and catalyst regeneration procedure. In a fluidized catalytic cracking (FCC) system, a stream of hydrocarbon feed is contacted with fluidized catalyst particles in a hydrocarbon cracking zone, or reactor, usually at a temperature of about 425°-600° C. The reactions of hydrocarbons in the hydrocarbon stream at this temperature result in deposition of carbonaceous coke on the catalyst particles. The resulting fluid cracked hydrocarbons and other vapors are separated from the coked catalyst and are withdrawn from the cracking zone. The coked catalyst is stripped of volatiles and cycled to a catalyst regeneration zone. In the catalyst regenerator, the coked catalyst is contacted with a gas, such as air, which contains a predetermined concentration of molecular oxygen to burn off a desired portion of the coke from the catalyst and simultaneously to heat the catalyst to a high temperature desired when the catalyst is again contacted with the hydrocarbon stream in the cracking zone. After regeneration, the catalyst is cycled to the cracking zone, where it is used to vaporize the hydrocarbons and to catalyze hydrocarbon cracking. The flue gas formed by combustion of coke in the catalyst regenerator is removed from the regenerator, and may be treated to remove particulates and carbon monoxide from it, after which it is normally passed into the atmosphere. Concern with control of pollutants in flue gas has resulted in a search for improved methods for controlling such pollutants. In the past, concern has centered on sulfur oxides and carbon monoxide. Nitrogen oxides have recently become a problem, at least partly because of the increased use of newer catalyst regeneration technology, e.g., use of platinum-containing combustion promoters to burn carbon monoxide.

The older, conventional type of FCC catalyst regeneration currently used in many FCC systems is an incomplete combustion mode. In such systems, referred to herein as "standard regeneration" systems, a substantial amount of coke carbon is left on regenerated catalyst passed from the FCC regeneration zone to the cracking zone. This may be, for example, a concentration of more than 0.2 weight percent carbon, usually about 0.25 to 0.45 weight percent carbon. The flue gas removed from an FCC regenerator operating in a standard regeneration mode is also characterized by a relatively high carbon monoxide/carbon dioxide concentration ratio. The atmosphere in much or all of the regeneration zone is, over-all, a reducing atmosphere because of the presence of substantial amounts of unburned coke carbon and carbon monoxide.

Prior to the introduction of zeolite-containing catalyst, there was little incentive to attempt to remove substantially all coke carbon from the catalyst, since even a fairly high carbon content has little adverse effect on the activity and selectivity of amorphous silica-alumina catalysts. Most of the FCC cracking catalysts now used, however, contain crystalline aluminosilicate zeolites, or molecular sieves. Zeolite-containing catalysts have usually been found to have relatively higher activity and selectivity when their coke carbon content after regeneration is relatively low. An incentive has thus arisen for attempting to reduce the coke content of regenerated FCC catalyst to a very low level, e.g., below 0.2 weight percent.

Several methods have been suggested for burning substantially all carbon monoxide to form carbon dioxide during regeneration, in order to avoid air pollution by the carbon monoxide, to recover heat and to prevent after-burning. Among the procedures suggested for use in obtaining complete carbon monoxide combustion in an FCC regenerator have been: increasing the amount of oxygen introduced into the regenerator relative to standard regeneration; and either substantially increasing the average operating temperature in the regenerator or including one or more carbon monoxide oxidation-promoting metals, such as platinum, in the system to promote carbon monoxide burning in the regenerator. Commercially, platinum has been employed in two ways: (a) on the catalyst itself, i.e., in low concentration on essentially all the particulate solids circulating in the cracking system; or (b) on a small amount of promoter particles, i.e., in high concentrations on only a very small fraction (less than 1%) of the particulate solids in the cracking system. Various solutions have also been suggested for the sometimes-related problem of after-burning of carbon monoxide. These solutions include addition of extraneous combustibles or use of water or heat-accepting solids to absorb the heat of combustion of carbon monoxide when the heat is released after the flue gas leaves the dense catalyst phase.

Complete combustion regeneration systems using a high temperature in the catalyst regenerator, rather than a promoter, to accomplish complete carbon monoxide combustion have been commercially employed. Much of the CO combustion takes place in a dilute catalyst phase in an after-burning mode, so that (1) more of the heat generated by carbon monoxide combustion is lost in the flue gas rather than absorbed in the catalyst, and (2) high temperatures are generated, with the possibility of a permanent adverse effect on the activity and selectivity of catalyst exposed to the dilute-phase flue gas.

Because of activity limitations, promoting metals, such as platinum, must be incorporated into particulate solids in relatively higher concentrations, e.g., 0.01 to 1 weight percent, when the promoted particles comprise a small fraction (e.g., less than 1%) of the total solids inventory in a cracking system.

When using carbon monoxide combustion-promoting metals associated with a small fraction of the total particulate solids inventory in a cracking system (including either promoted particulate catalyst or any other promoted solids in the system, or both), essentially complete carbon monoxide combustion has been obtained commercially. Low levels of coke on regenerated catalyst, another desirable result, have also been obtained. On the other hand, the amount of undesirable nitrogen oxides formed in the regenerator flue gas has substantially increased in catalyst regenerators using promoting metals contained on a small fraction of the circulating particulate solids. This has created a serious air pollution problem in disposing of the flue gas. Despite the $NO_x$ problems, use of combustion promoters comprising only a small fraction of the total solids inventory in a cracking system is still often preferable to use of a small amount of promoting metal on a large fraction of the solids. This is because of the flexibility permitted using a small amount of additive. E.g., use of the additive can be discontinued rapidly without removing a large portion of the catalyst inventory.

Several modes of addition of Group VIII noble metals and other carbon monoxide combustion-promoting metals to FCC systems have been suggested in the art. In U.S. Pat. No. 2,647,860 it is proposed to add 0.1–1 weight percent chromic oxide to an FCC catalyst to promote combustion of carbon monoxide to carbon dioxide and to prevent after-burning. U.S. Pat. No. 3,364,136 proposes to employ particles containing a small-pore (3–5 A.) molecular sieve with which is associated a transition metal from Groups IB, IIB, VIB, VIIB and VIII of the Periodic Table, or compounds thereof, such as a sulfide or oxide. Representative metals disclosed include chromium, nickel, iron, molybdenum, cobalt, platinum, palladium, copper and zinc. The metal-loaded, small-pore zeolite may be used in an FCC system in physical mixture with cracking catalysts containing larger-pore zeolites active for cracking, or the small-pore zeolite may be included in the same matrix with zeolites active for cracking. The small-pore, metal-loaded zeolites are suggested for the purpose of increasing the $CO_2/CO$ ratio in the flue gas produced in the FCC generator. In U.S. Pat. No. 3,788,977, it is proposed to add uranium or platinum impregnated on an inorganic oxide such as alumina to an FCC system, either in physical mixture with FCC catalyst or incorporated into the same amorphous matrix as a zeolite used for cracking. Uranium or platinum is added for the purpose of producing gasoline fractions having high aromatics contents, and the effect on carbon monoxide combustion when using the additive is not discussed in the patent. In U.S. Pat. No. 3,808,121 it is proposed to supply large-size particles containing a carbon monoxide combustion-promoter metal in an FCC regenerator. The smaller-size catalyst particles are cycled between the FCC cracking reactor and the catalyst regenerator, while, because of their size, the larger promoter particles remain in the regenerator. Carbon monoxide oxidation promoters such as cobalt, copper, nickel, manganese, copper chromite, etc., impregnated on an iorganic oxide such as alumina are disclosed for use. Belgian patent publication No. 820,181 suggests using catalyst particles containing platinum, palladium, iridium, rhodium, osmium, ruthenium or rhenium or mixtures or compounds thereof to promote carbon monoxide oxidation in an FCC catalyst regenerator. An amount between a trace and 100 ppm of the active metal is added to FCC catalyst particles by incorporation during catalyst manufacture or by addition of a compound of the metal to the hydrocarbon feed to an FCC unit using the catalyst. The publication asserts that addition of the promoter metal increases coke and hydrogen formation during cracking.

U.S. Pat. Nos. 4,072,600 and 4,093,535 disclose the use of combustion-promoting metals in catalytic cracking systems in concentrations of 0.01 to 50 ppm, based on total catalyst inventory.

SUMMARY OF THE INVENTION

In one embodiment of the present invention, a process is provided for cracking hydrocarbons in the absence of externally supplied molecular hydrogen in a cracking system employing an inventory of circulating particulate solids including cracking catalyst particles, said inventory being cycled between a cracking zone and a catalyst regeneration zone, wherein said hydrocarbons are cracked in contact with said catalyst particles and coke is formed on said catalyst particles at cracking conditions in said cracking zone, flue gas is formed by burning coke off said catalyst particles with a molecular oxygen-containing and molecular nitrogen-containing gas at regeneration conditions in said regeneration zone, and carbon dioxide and nitrogen oxides are formed by combusting carbon monoxide in the presence of carbon monoxide combustion promoter particles comprising a combustion-promoting metal or compound of a metal associated with at least one particulate solid, said particulate solid being selected from at least one of (1) at least a portion of said catalyst particles, (2) a particulate solid physically admixed with said catalyst particles in said inventory of particulate solids, and (3) a particulate solid retained in said regeneration zone, wherein the method for reducing the amount of nitrogen oxides in said flue gas comprises:

employing carbon monoxide combustion promoter particles including from 0.1 to 10,000 parts per million, by weight, of platinum and, for each part of platinum, from 0.001 to 1 part, by weight, of a nitrogen oxides-reducing component comprising at least one metal selected from rhodium and iridium.

Platinum has been found to possess a desirable, very high activity for promoting combustion of CO in cracking catalyst regeneration. This has typically been accompanied by excessive production of undesirable nitrogen oxides. I have now found that the high carbon monoxide combustion-promoting activity of platinum can be retained while formation of excessive amounts of undesirable $NO_x$ can be substantially suppressed by using, in addition to platinum, a small amount of iridium or rhodium.

DETAILED DESCRIPTION OF THE INVENTION

The present invention is used in connection with a fluid catalyst cracking process for cracking hydrocarbon feeds. The same hydrocarbon feeds normally processed in commercial FCC systems may be processed in a cracking system employing the present invention. Suitable feedstocks include, for example, petroleum distillates or residuals, either virgin or partially refined. Synthetic feeds such as coal oil and shale oils are also suitable. Suitable feedstocks normally boil in the range from about 200°–600° C. or higher. A suitable feed may include recycled hydrocarbons which have already been subjected to cracking.

The cracking catalyst employed may be a conventional particulate cracking catalyst including siliceous inorganic oxides such as silica-alumina. The catalyst may, for example, be a conventional non-zeolitic cracking catalyst containing at least one porous inorganic oxide, such as silica, alumina, magnesia, zirconia, etc., or a mixture of silica and alumina or silica and magnesia, etc., or a natural or synthetic clay. The catalyst may also be a conventional zeolite-containing cracking catalyst including a crystalline aluminosilicate zeolite associated with a porous refractory matrix which may be silica-alumina, clay or the like. The matrix generally constitutes 70–95 weight percent of the cracking catalyst, with the remaining 5–30 weight percent being a zeolite component dispersed on or embedded in the matrix. The zeolite may be rare earth-exchanged or hydrogen-exchanged. Conventional zeolite-containing cracking catalysts often include an X-type zeolite or a Y-type zeolite. Low (less than 1%) sodium content Y-type zeolites are particularly good. As will be apparent to those skilled in the art, the composition of the catalyst particles employed in the system is not a critical feature of the present method except for the carbon monoxide combustion-promoting metal contents (discussed below) in embodiments in which the promoting metal is associated with catalyst particles. Thus, the catalyst may be either completely amorphous or crystalline and partly non-crystalline.

Cracking conditions employed in the cracking or conversion step in an FCC system are frequently provided in part by pre-heating or heat-exchanging hydrocarbon feeds to bring them to a temperature of about 315°–400° C. before introducing them into the cracking zone; however, pre-heating of the feed is not essential. Cracking conditions normally include a catalyst/hydrocarbon weight ratio of about 3–10. A hydrocarbon weight space velocity in the cracking zone of about 5–50 per hour is preferably used. The average amount of coke contained in the catalyst after contact with the hydrocarbons in the cracking zone, when the catalyst is passed to the regenerator, is preferably between about 0.5 weight percent and about 2.5 weight percent, depending in part on the carbon content of regenerated catalyst in the particular system, as well as the heat balance of the particular system.

The catalyst regeneration zone used in an FCC system employing an embodiment of the present invention may be of conventional design. The gaseous atmosphere within the regeneration zone normally includes a mixture of gases in concentrations which vary according to the locus within the regenerator. The concentrations of gases also vary according to the coke concentration on catalyst particles entering the regenerator and according to the amount of molecular oxygen and steam passed into the regenerator. Generally, the gaseous atmosphere in a regenerator contains 5–25% steam, varying amounts of oxygen, carbon monoxide, carbon dioxide and nitrogen. The present invention is applicable in cases in which an oxygen-containing and nitrogen-containing gas, such as air, is employed for combustion of coke in the catalyst regenerator. As will be appreciated by those skilled in the art, air is almost invariably employed to provide some or all of the oxygen needed for combustion in FCC regenerators.

The platinum and iridium or rhodium carbon monoxide combustion-promoting particles may be in a form suitable for circulation in the circulating particulate solids inventory in a cracking system or may be in a form which remains within the catalyst regeneration zone. The platinum- and iridium- or rhodium-containing combustion-promoting metals may be associated with at least one of the following particulate carriers: (1) all or a portion of the catalyst particles circulating in a cracking system; (2) a particulate solid other than the catalyst such as a finely divided, porous inorganic oxide; (3) particles which, because of physical properties, remain in the catalyst regenerator at all times, rather than circulating with the catalyst particles. Preferably, the promoted particles form a part of the circulating particulate solids inventory.

In embodiments in which the promoter is circulated in the cracking system as part of the particulate solids inventory, the total amount of platinum used in an FCC system, with respect to the circulating particulate solids inventory, is between about 0.01 and 1000 parts per million, by weight, with an amount of platinum between about 0.1 and 10 parts per million of the inventory being particularly preferred. It will be apparent that the concentration of platinum in platinum-promoted particles circulated in the particulate solids inventory will be relatively greater when a relatively smaller proportion of the total particulate solids inventory contains platinum. The concentration of platinum in discrete promoted particles is usually within the range from 0.1 ppm, by weight, to 1 weight percent (10,000 ppm). Preferably, the concentration of platinum in promoted particles is between 10 and 1000 ppm, by weight.

According to the invention, iridium and/or rhodium are combined with platinum in promoted particles. The total amount of iridium, rhodium, or a mixture thereof, used depends on the amount of platinum. For each part of platinum, by weight, in promoted particles the total amount of iridium, rhodium, or both, is from 0.001 to 1.0 part, by weight. Preferably the weight ratio of platinum to iridium and/or rhodium is between 200:1 and 2:1. The platinum and iridium or rhodium, or both, can be separately, serially introduced into suitable carrier particles or a precursor of a carrier. The metals can also be introduced onto a formed solid carrier or into a carrier precursor simultaneously. For example, the metals can be introduced by conventional aqueous mixture of water-soluble salts of platinum, iridium and/or rhodium, or the metals can be introduced by successive impregnations with separate solutions.

The combustion-promoting platinum and $NO_x$-reducing rhodium or iridium are particularly preferably employed in an FCC system in association with discrete, promoted particulate solids, which are physically admixed with, and circulated in the FCC system with unpromoted catalyst particles. The promoted particulate solids, if wholly or partially different in composition from the catalyst particles in any way other than by the presence of the promoting metals, may be formed from any material which is suitable for circulation in an FCC system in admixture with the catalyst particles. Particularly suitable materials are the porous inorganic oxides, such as alumina, silica, zirconia, etc., or mixtures of two or more inorganic oxides, which may be amorphous, crystalline, or both, such as silica-alumina, natural and synthetic clays and the like, crystalline aluminosilicate zeolites, etc. Gamma-alumina is particularly good. The platinum and iridium and/or rhodium can be added to a particulate solid, such as catalyst particles or other particulate materials, to form a promoted particulate solid in any suitable manner, as by impregnation or ion exchange, or can be added to a precursor of a particulate solid, as, for example, by precipitation from an aqueous solution with an inorganic oxide precursor sol. The promoted particulate solids can then be formed into particles of a size suitable for use in an FCC system by conventional means, such as spray-drying, crushing of larger particles to the desired size, etc.

Particles promoted with platinum and iridium and/or rhodium can be introduced in any convenient manner to a catalytic cracking unit. A promoted particulate solid can, for example, be physically admixed with unpromoted catalyst particles and the mixture can then be charged to an FCC system. The promoted particulate solids can optionally be introduced separately in the desired amount to an FCC unit already containing a substantial inventory of unpromoted or promoted particulates. Optionally, the complete inventory of particulate solids can be promoted.

Substantially complete combustion of carbon monoxide and coke is preferably carried out in a cracking catalyst regenerator employing the promoter of the invention. Sufficient coke is preferably burned off the catalyst during regeneration to provide an average level of coke on regenerated catalyst of less than 0.2 weight percent, and particularly preferably less than 0.1 weight percent. The carbon monoxide produced in the catalyst regenerator is preferably substantially all burned to carbon dioxide. The flue gas removed from the regenerator preferably has not more than 5000 parts per million, by volume, of CO therein, particularly preferably not more than 1000 parts per million, by volume.

The amount of oxygen must be at least sufficient to burn the desired amount of coke and carbon monoxide. Thus, sufficient oxygen must be introduced into the regeneration zone so that flue gas removed from the regeneration zone contains at least 0.5 volume percent molecular oxygen. Oxygen in the flue gas is herein termed "excess" oxygen. At least 0.5 volume percent excess oxygen is typically needed in order to provide the high degree of coke and carbon monoxide burning usually desired in a catalyst regeneration operation using a platinum combustion promoter.

Preferably, the catalyst regeneration zone includes at least one dense-phase bed of fluidized particulate solids (density greater than 10 pounds per cubic foot). Two or more dense beds may be employed if a plurality of regeneration chambers is used, as in staged regeneration. Preferably, substantially all the carbon monoxide generated in a dense-phase catalyst bed is burned to carbon dioxide in the dense-phase bed. It is also preferred to control the average temperature of dense-phase beds of solids in a regeneration zone so that the average temperature does not exceed 675° C. Dense-phase burning of the carbon monoxide generated in an FCC catalyst regenerator is indicated when the average temperature in a dilute phase above a dense-phase catalyst bed is only slightly different, or lower than, the average temperature in the dense phase.

The following examples illustrate the operation of the present invention and show the superiority of bimetallic Pt-Rh and Pt-Ir combustion promoters relative to a conventional monometallic Pt carbon monoxide combustion promoter.

EXAMPLE I

A conventional monometallic platinum carbon monoxide combustion promoter composition was made by mixing 2.13 grams of chloroplatinic acid with 192 ml of water and impregnating the resulting solution onto 600-grams of $Al_2O_3.3H_2O$ by the pore-fill method. The impregnated composition was dried for about 64 hours at 140° C. in a vacuum oven with a nitrogen purge, and then calcined in dry air at 593° C. for six hours. The resulting composition was designated Catalyst A. According to the invention, a bimetallic platinum-rhodium carbon monoxide combustion promoter was then prepared by diluting 0.51 grams of $RhCl_3.3H_2O$ to 100 ml of water. A 2.5 ml aliquot of the resulting solution was then diluted to 15.8 ml with water. The resulting solution was impregnated onto 25 grams of Catalyst A by the pore-fill method. The impregnated composition was dried overnight in a vacuum oven at 140° C. with a nitrogen purge, and calcined in dry air at 593° C. for four hours. The resulting composition was designated Catalyst B. Further according to the invention, a bimetallic platinum-iridium carbon monoxide combustion promoter was prepared by diluting 0.5 grams of $(NH_4)_3IrCl_3.XH_2O$ (40 weight percent iridium) to 100 ml with water. A 2.5 ml aliquot of the resulting solution was then diluted with water to 15.8 ml. The resulting solution was then impregnated onto 25 grams of Catalyst A by the pore-fill method. The impregnated composition was dried overnight in a vacuum oven at 140° C. with a nitrogen purge and then calcined in dry air at 593° C. for four hours. The resulting composition was designated Catalyst C.

EXAMPLE II

The three carbon monoxide combustion promoters prepared as described in Example I were each tested for carbon monoxide combustion activity and nitrogen oxides ($NO_x$) generation activity. In each test, 0.02 gram of a combustion promoter was mixed with 2 grams of a spent, commercial FCC cracking catalyst containing one weight percent coke carbon. The sample of mixed combustion promoter and spent cracking catalyst was placed in a ¼-inch O.D quartz tube and heated to 677° C. A stream of air was passed through the sample at the rate of 17.6 cc per minute. The effluent gas was measured for $NO_x$ content and was collected. After essentially complete combustion of all the coke in the catalyst, the test was terminated and the collected effluent gas was analyzed to determine the carbon dioxide and carbon monoxide concentrations in it. The results of the tests with each of the three combustion promoting catalysts are shown in the Table.

TABLE

| Combustion Promoting Catalyst | Promoter Metal Pt(wt. %) | Rh(ppm) | Ir(ppm) | $NO_x$ Generated (ppm) | Percent Carbon Monoxide Conversion |
|---|---|---|---|---|---|
| A | 0.2 | — | — | 2331 | 97.5 |
| B | 0.2 | 200 | — | 1657 | 96.8 |
| C | 0.2 | — | 200 | 1740 | 97.1 |

Referring to the Table, $NO_x$ generation activity for each combustion promoter was determined by continuous analysis of the test gas effluent and use of the peak $NO_x$ reading, as this figure has been found to correlate well with $NO_x$ generation activity of combustion promoters in commercial FCC operations. Carbon monoxide and carbon dioxide concentrations were measured by gas chromatography. It will be readily apparent from comparison of the results shown in the Table that Catalyst B (Pt-Rh) and Catalyst C (Pt-Ir) provided essentially the same degree of carbon monoxide conversion as Catalyst A (Pt), but that addition of only one part of Rh or Ir to 10 parts of platinum resulted in a dramatic and very surprising decrease in the formation of $NO_x$, giving a drop of 29 percent in $NO_x$ formation for Catalyst B, relative to Catalyst A, and a drop of 25 percent in $NO_x$ formation for Catalyst C relative to Catalyst A.

The following illustrative embodiment describes a preferred embodiment of the operation of the present invention.

ILLUSTRATIVE EMBODIMENT

A conventional FCC system and equilibrium, zeolite-containing, cracking catalyst of a commercially available type are employed for cracking about 20 M barrels per day of a hydrocarbon fresh feed having a boiling range of about 290° C. to about 590° C. and about 5 M barrels per day of a heavy cycle oil having a boiling range of about 260°-425° C. The cracking zone used employs a combination of riser cracking and dense-bed cracking mode. Cracking conditions include a reactor temperature of about 495° C., a total hydrocarbon weight hourly space velocity of about 8 per hour and a conversion rate (defined as percent of feed converted to 221° C. and lighter components) of about 83%. The average amount of coke on spent catalyst is about 1.0 weight percent. The amount of carbon on regenerated catalyst is about 0.5 weight percent. The flue gas exiting the catalyst regenerator includes about 0.3 volume percent oxygen, and has a $CO/CO_2$ ratio of about 1.28. Catalyst regeneration conditions used in the regeneration zone include a temperature of about 652° C. Catalyst is circulated continuously between the cracking zone and regeneration zone at the rate of about 14.8 metric tons/min with a total catalyst inventory in the system of about 159 metric tons. The level of conversion in the system is found to be 83 volume percent. For the purpose of comparison, with the promoter of the present invention, 40.8 kg of conventional, commercial combustion-promoter particles containing 0.2 weight percent platinum disposed on an alumina carrier are introduced into the regenerator of the FCC unit in one dump. Introduction of the platinum-alumina particles is then continued at the rate of about 2.25 kg per 900 kg of fresh cracking catalyst. The amount of platinum added to the system is thereby maintained at an equilibrium level of about 3.1 parts per million, by weight, with respect to the total amount of catalyst in the system. Most of the carbon monoxide is burned in a vapor-phase portion of a dense-catalyst-phase region in the regenerator. A sufficient amount of oxygen is added to the regenerator to provide 1.5 volume percent oxygen in the regenerator atmosphere, as determined by measuring the oxygen content of flue gas leaving the regenerator. The temperature of the dense-phase region in the regenerator is maintained at 652°±5.5° C. A sufficient amount of coke is burned off the catalyst in the regenerator so that the carbon content of the regenerated catalyst passed from the regenerator to the reactor is only about 0.08 weight percent. After addition of the platinum-alumina carbon-monoxide-combustion promoter particles, the $CO/CO_2$ ratio in the flue gas exiting the regeneration zone is measured. The $CO/CO_2$ volume ratio is found to be substantially reduced, to below 0.002. The level of conversion in the cracking reactor is found to have increased to 86 volume percent. The amount of NO in the flue gas is measured and is found to be 400 parts per million, by volume. According to the invention, particles of a promoter are prepared by spray-drying alumina and impregnating the resulting particles with an aqueous solution containing a sufficient amount of a platinum compound to provide 0.18 weight percent platinum in the particles and sufficient amount of an iridium compound to provide 0.02 weight percent iridium in the particles. This carbon monoxide combustion promoter is then used in the same FCC system under the same operating conditions under which the platinum-only combustion promoter has previously been used. The $CO/CO_2$ volume ratio in the flue gas is again measured, and is found to be below 0.002, while the amount of NO in the flue gas is measured and is found to be only 300 parts per million, i.e., a substantial reduction from that produced in an identical regeneration step using a conventional combustion promoter.

As can be seen from the foregoing description and illustrative embodiment, the present invention provides a simple and economical way to reduce the nitrogen oxides level in regenerator flue gas in a platinum-promoted, complete-combustion-type cracking system, while maintaining the desired low level of coke on regenerated catalyst and high conversion found in complete combustion systems using a particulate platinum-containing combustion promoter. A large number of obvious variations, modifications and equivalents of the preferred embodiment set forth will be apparent to those skilled in the art and these equivalents and adaptations are intended to be included within the scope of the appended claims.

What is claimed is:

1. In a process for cracking hydrocarbons in the absence of externally supplied molecular hydrogen in a cracking system employing an inventory of circulating particulate solids including cracking catalyst particles, said inventory being cycled between a cracking zone and a catalyst regeneration zone, wherein said hydrocarbons are cracked in contact with said catalyst particles and coke is formed on said catalyst particles at cracking conditions in said cracking zone, flue gas is formed by burning coke off said catalyst particles with a molecular oxygen-containing and molecular nitrogen-containing gas at regeneration conditions in said regeneration zone, and carbon dioxide and nitrogen oxides are formed by combusting carbon monoxide in the presence of carbon monoxide combustion promoter particles comprising a combustion-promoting metal or compound of a metal associated with at least one particulate solid, said particulate solid being selected from at least one of (1) at least a portion of said catalyst particles, (2) a particulate solid physically admixed with said catalyst particles in said inventory of particulate solids, and (3) a particulate solid retained in said regeneration zone, the method for reducing the amount of nitrogen oxides in said flue gas comprising:

employing carbon monoxide combustion promoter particles including from 0.1 to 10,000 parts per million, by weight, of platinum and, for each part of platinum, from 0.001 to 1 part, by weight, of a nitrogen oxides-reducing component comprising at least one metal selected from rhodium and iridium.

2. A method according to claim 1 wherein said combustion promoter particles include from 0.1 to 100 parts per million, by weight, of platinum.

3. A method according to claim 1 wherein said combustion promoter particles include from 0.005 to 0.5 part, by weight, of said nitrogen oxides-reducing component for each part of platinum therein.

4. A method according to claim 1 wherein said nitrogen oxides-reducing component is rhodium.

5. A method according to claim 1 wherein said nitrogen-oxides-reducing component is iridium.

* * * * *

UNITED STATES PATENT AND TRADEMARK OFFICE

CERTIFICATE OF CORRECTION

PATENT NO. : 4,290,878

DATED : September 22, 1981

INVENTOR(S) : William A. Blanton, Jr.

It is certified that error appears in the above—identified patent and that said Letters Patent is hereby corrected as shown below:

On The Title Page, Abstract line 3, "empolying" should read -- employing --. Column 3, line 38, "generator" should read -- regenerator --. Colum- 8, line 3, "Ml of water" should read -- Ml in water --. Column 8, line 45, "Promoter" should read -- Promoter --

Metal Metal

Signed and Sealed this

Eighth Day of December 1981

[SEAL]

Attest:

GERALD J. MOSSINGHOFF

Attesting Officer

Commissioner of Patents and Trademarks